US006857930B1

(12) United States Patent
Lawley, Jr.

(10) Patent No.: US 6,857,930 B1
(45) Date of Patent: Feb. 22, 2005

(54) REMOTE CONTROL TOY VEHICLE

(76) Inventor: Neil Lawley, Jr., 4035 Mitchell St., Philadelphia, PA (US) 19128

( * ) Notice: Subject to any disclaimer, the term of this patent is extended or adjusted under 35 U.S.C. 154(b) by 0 days.

(21) Appl. No.: 10/810,192

(22) Filed: Mar. 26, 2004

(51) Int. Cl.[7] ..... A63H 30/04

(52) U.S. Cl. ..... 446/456; 446/73; 446/435; 446/470; 206/427

(58) Field of Search ..... 446/71–73, 75, 446/78, 93, 95, 428, 430, 435, 448, 465, 454–457, 470, 471, 475; 206/427, 139

(56) References Cited

U.S. PATENT DOCUMENTS

| | | | | | |
|---|---|---|---|---|---|
| 2,735,221 | A | * | 2/1956 | Fields | 446/435 |
| 3,675,365 | A | * | 7/1972 | Silva | 446/134 |
| 4,508,516 | A | * | 4/1985 | D'Andrade et al. | 446/443 |
| 5,024,626 | A | | 6/1991 | Robbins | 446/409 |
| 5,380,231 | A | * | 1/1995 | Brovelli | 446/6 |
| 5,395,274 | A | | 3/1995 | Myers | 446/16 |
| 5,842,907 | A | * | 12/1998 | Niimura et al. | 446/435 |
| 5,888,135 | A | | 3/1999 | Barton | 463/39 |
| 5,897,038 | A | * | 4/1999 | Myers | 222/608 |
| 6,488,556 | B2 | * | 12/2002 | Galomb | 446/73 |

* cited by examiner

*Primary Examiner*—Bena Miller
(74) *Attorney, Agent, or Firm*—Goldstein Law Offices, P.C.

(57) ABSTRACT

A toy vehicle having a receiver, a drive motor, a steering motor, and a plurality of spring assemblies. The spring assemblies each have a spring, a solenoid, and a pin. The toy vehicle includes a rear cargo unit having a plurality of receptacles for housing the springs therein. A beverage can is stored on top of each spring, and when the solenoid is energized, the pin is released and the can is pushed upwardly into the air. The receiver is in communication with a remote transmitter, having directional controls for controlling the drive motor and the steering motor, and can release buttons. The remote transmitter signals the receiver for controlling the drive motor, the steering motor, and the spring assemblies.

9 Claims, 5 Drawing Sheets

REMOTE CONTROL TOY VEHICLE

BACKGROUND OF THE INVENTION

The invention relates to a toy vehicle, and more particularly, to a remote control toy vehicle for storing and refrigerating cans of beer or soda, which includes a can release system for selectively popping the cans into the air.

Americans love their beer. Whether they are playing poker, watching a football game, or just relaxing with friends, having cold beers on hand is an absolute necessity. All kinds of beers are available today and they run the spectrum from sweet and light, to tangy, to dark and flavored. For those beer enthusiasts looking for an alternative to mass-produced beer, microbrews have become popular.

U.S. Pat. No. 5,395,274 to Myers discloses a remote control vehicle capable of dispensing a stream of bubbles. U.S. Pat. No. 5,024,626 to Robbins discloses a remote control toy vehicle having means to produce sound. U.S. Pat. No. 5,888,135 to Barton discloses a system to control a number of remote vehicles in a simultaneous manner.

While these units may be suitable for the particular purpose employed, or for general use, they would not be as suitable for the purposes of the present invention as disclosed hereafter.

SUMMARY OF THE INVENTION

It is an object of the invention to produce a remote control toy vehicle capable of storing and transporting cans of beer and soda therein. Accordingly, the invention is a remote control toy vehicle, having a rear cargo unit having receptacles therein, which are sized to accommodate cans of beer and soda, for easily storing and transporting the beer and soda therein.

It is another object of the invention to provide a remote control toy vehicle, which is capable of releasing beverages contained therein from the vehicle into the air. Accordingly, the recessed receptacles of the invention each have a spring attached thereto, which is positionable underneath a can of beer or soda. The spring is energized by a solenoid for pushing the can upwardly from the receptacle into the air.

It is another object of the invention to provide a remote control toy vehicle capable of keeping beverages contained therein cold. Accordingly, the rear cargo unit of the toy vehicle around the receptacles is filled with ice cubes for keeping the beverages cold.

The invention is a toy vehicle having a receiver, a drive motor, a steering motor, and a plurality of spring assemblies. The spring assemblies each have a spring, a solenoid, and a pin. The toy vehicle includes a rear cargo unit having a plurality of receptacles for housing the springs therein. A beverage can is stored on top of each spring, and when the solenoid is energized, the pin is released and the can is pushed upwardly into the air. The receiver is in communication with a remote transmitter, having directional controls for controlling the drive motor and the steering motor, and can release buttons. The remote transmitter signals the receiver for controlling the drive motor, the steering motor, and the spring assemblies.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
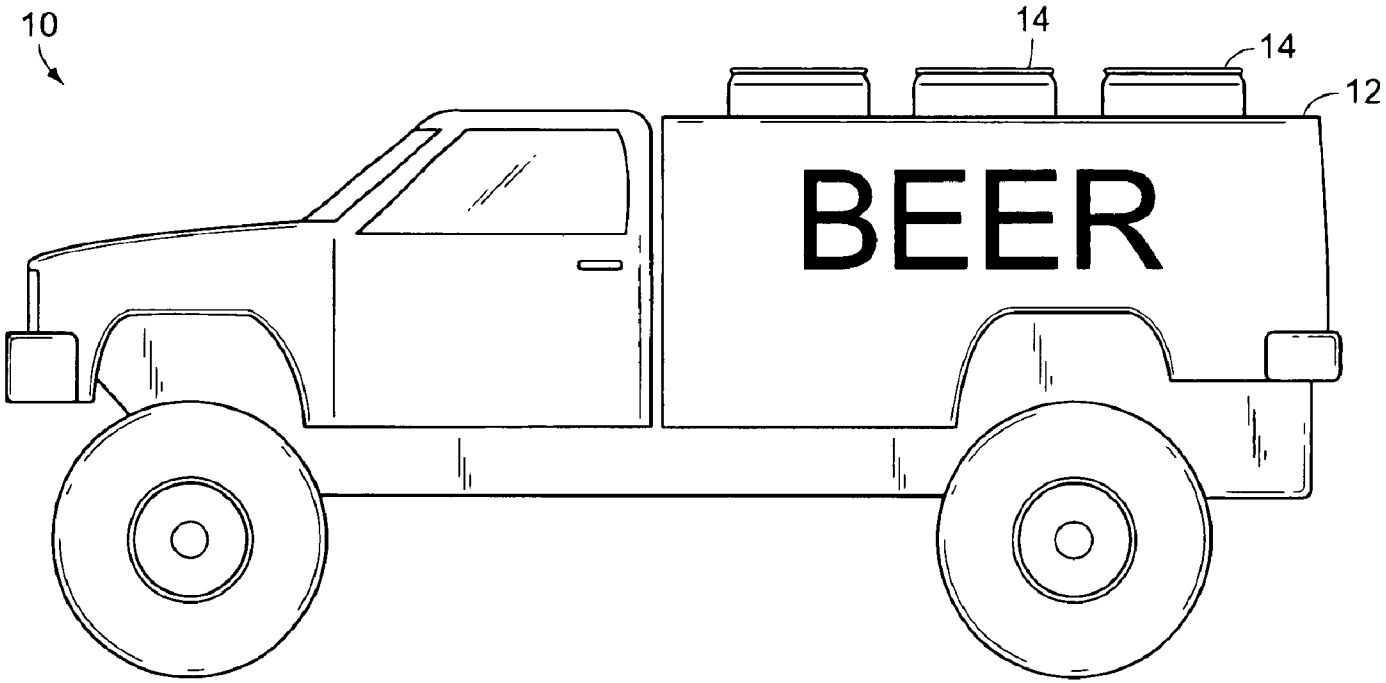
FIG. 1 is a side elevational view of the toy vehicle of the present invention having a rear cargo unit for storing and transporting cans of beer and soda therein.

FIG. 1 illustrates a toy vehicle 10 of the present invention under the control of a remote transmitter, for storing, transporting, and delivering cold beverages to a user. The toy vehicle 10 has a rear cargo unit 12 for storing beverages therein. In particular, cans of beer and soda 14 are stored within the rear cargo unit 12 of the toy vehicle 10. The toy vehicle 10 resembles a beer or soda delivery truck.

Figure 2:
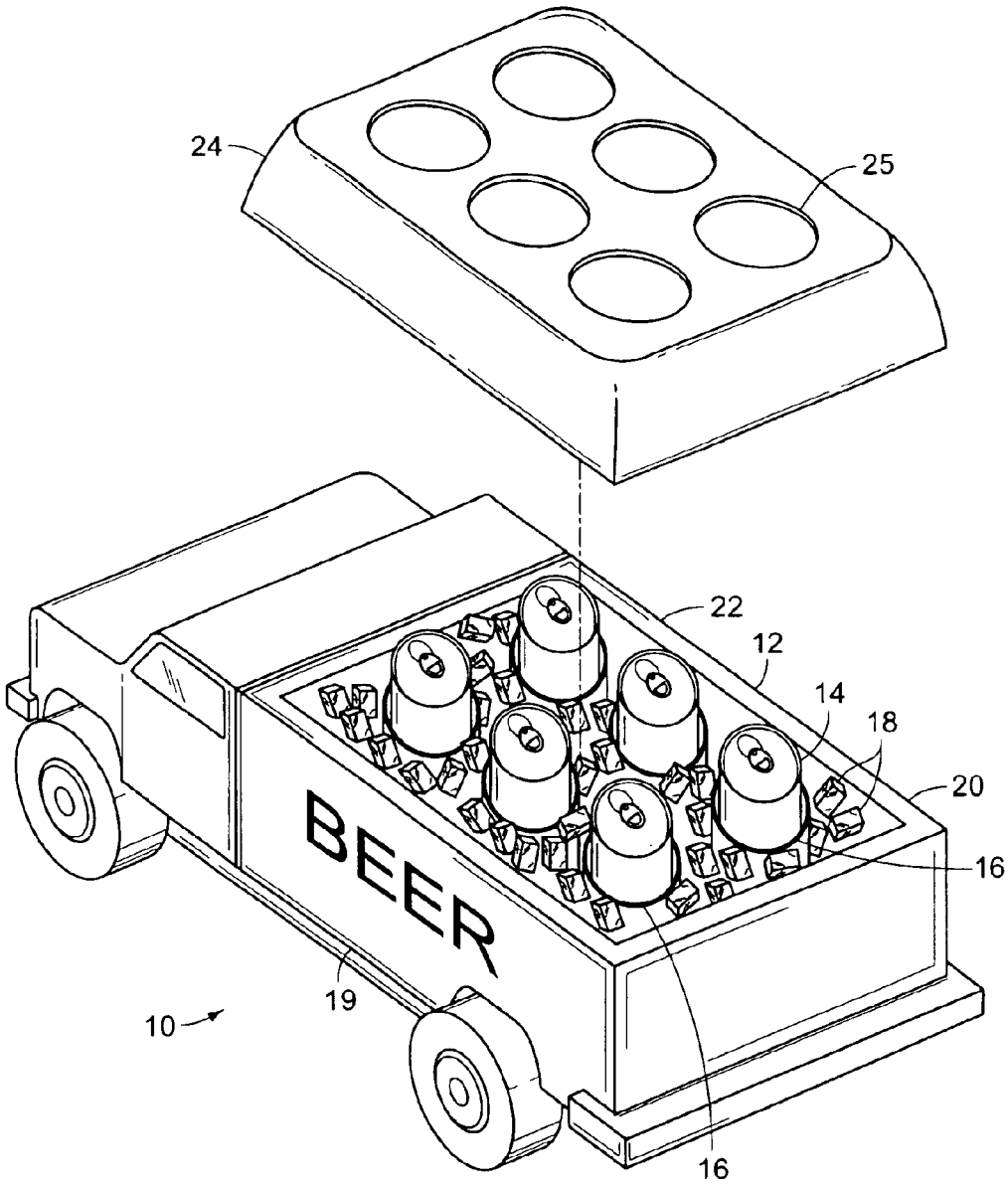
FIG. 2 is a perspective view of the toy vehicle of the present invention showing a plurality of circular receptacles recessed within the rear cargo unit for accommodating a plurality of cans therein.

FIG. 2 illustrates the rear cargo unit 12 of the toy vehicle 10 of the present invention. The rear cargo unit 12' of the toy vehicle 10 has a bottom surface 19. The rear cargo unit 12, of the toy vehicle 10, has four rectangular walls 20 that extend upwardly from the bottom surface 19. A horizontal upper edge 22 is defined by the rectangular walls 20 of the rear cargo unit 12. The rear cargo unit 12 has a removably secured lid 24, that is used to cover the otherwise exposed rear cargo unit 12. The removable lid 24 has a plurality of circular openings 25 extending therethrough for accepting the cans of beer and soda therein. The removable lid 24 grips the horizontal upper edge 22 of the rear cargo unit 12 and prevents items stored therein, like ice, from falling out. When attached to the rear cargo unit 12, the removable lid 24 still allows the cans of beer and soda to be thrust into the air through the openings 25 in the lid.

A plurality of circular receptacles 16 are recessed within the rear cargo unit 12. The circular receptacles 16 are sized to accommodate cans of beer and soda 14 placed therein. The circular receptacles 16 are spaced apart from one another, leaving open space therebetween. Ice cubes 18 are placed in the open space between the circular receptacles 16 for keeping the cans of beer and soda 14 cold.

Figure 3:
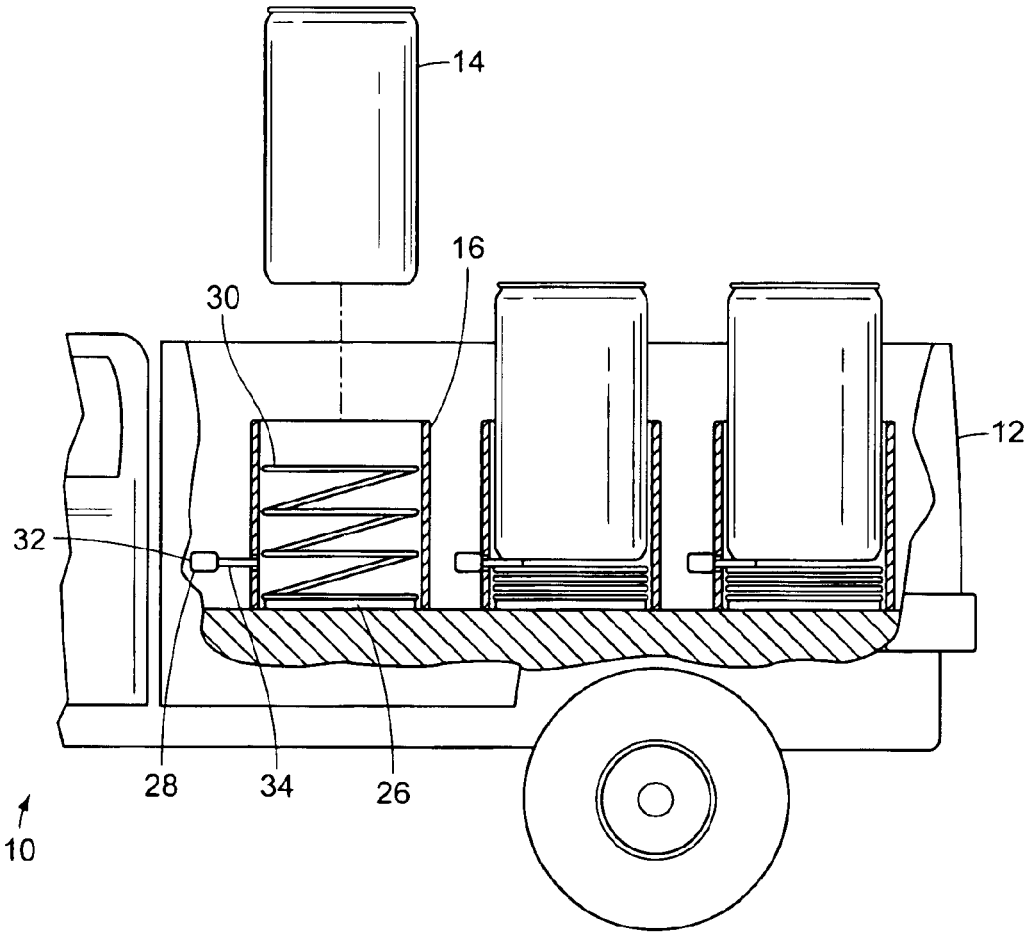
FIG. 3 is a side elevational view of the toy vehicle of the present invention with parts broken away illustrating the circular receptacles of the rear cargo unit having spring assemblies attached thereto for releasing cans into the air.

FIG. 3 illustrates the toy vehicle 10 with parts broken away from the rear cargo unit 12, to reveal the circular receptacles 16. The circular receptacles 16 include a bottom interior surface 26. The circular receptacles 16 are adapted to accommodate the cans of beer and soda 14 therein. A spring assembly 28 is used to release the cans of beer and soda 14 into the air from each circular receptacle 16 of the toy vehicle 10. The spring assemblies 28 each include a spring 30 and a solenoid 32. The spring 30 of each spring assembly is attached to the bottom interior surface 26 of each circular receptacle 16. The solenoids 32 of each spring assembly 28, has a pin 34, which extends through the circular receptacle 16 and is positioned above the spring 30 in order to hold the spring in a coiled position below the pin 34. When the solenoid 32 is energized, the pin 34 is withdrawn or retracted from the circular receptacle 16 and the spring 30 is able to automatically uncoil upwardly with force. The cans of beer and soda are positioned on top of the spring 30 while the spring is coiled under the pin 34. When the solenoid 32 energizes and the pin 34 retracts and the spring 30 automatically uncoils thrusting the can of beer or soda 14 upwardly into the air.

Figure 4:
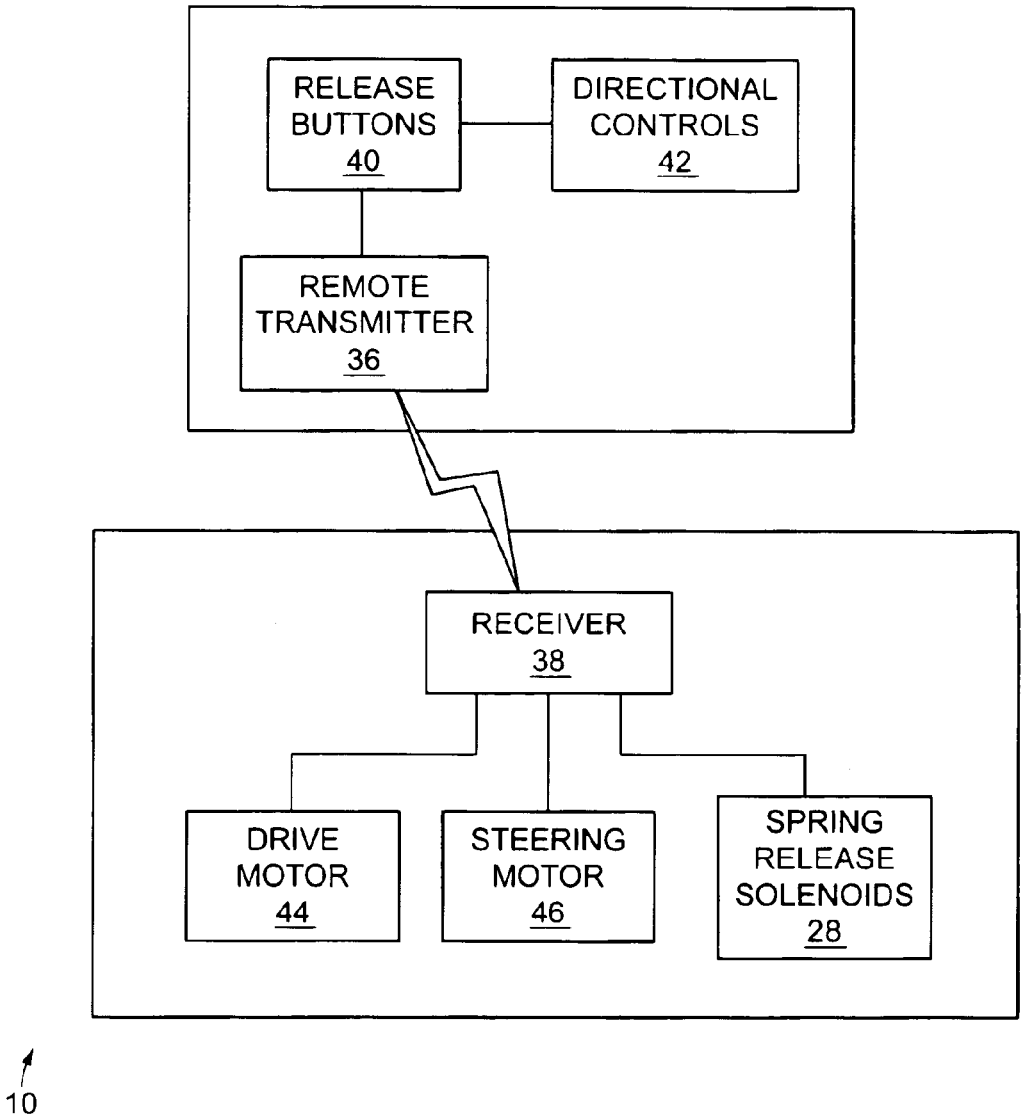
FIG. 4 illustrates a block diagram of the toy vehicle under the control of a remote transmitter, wherein said remote transmitter is in communication with a receiver for controlling the spring assemblies.

FIG. 4 illustrates a block diagram of the present invention having a remote transmitter 36. A receiver 38 is on board the toy vehicle 10 and is in communication with the remote transmitter 36. The remote transmitter 36 has both can release buttons 40 and directional controls 42 thereon. The toy vehicle 10 includes a drive motor 44, and a steering motor 46, in communication with the receiver 38 for receiving signals.

The direction controls 42 of the remote transmitter 36 are used to remotely control the drive motor 44 and steering motor 46 of the toy vehicle 10. The directional controls 42 of the remote transmitter 36 include a first joystick and a second joystick. The first joystick is used to control the drive motor 44 of the toy vehicle 10, while the second joystick is used to control the steering motor 46 of the toy vehicle 10. When the user actuates the first joystick of the remote transmitter 36, said remote transmitter 36 sends a radio signal through an antenna to the receiver 38 on board the toy vehicle 10. The receiver 38 is in communication with the drive motor 44 and triggers the drive motor 44 to accelerate, decelerate, and reverse direction. When the user actuates the second joystick of the remote transmitter 36, said remote transmitter sends a radio signal through the antenna to the receiver 38 on board the toy vehicle 10. The, receiver 38 is in communication with the steering motor 46 and triggers the steering motor 46 to move the toy vehicle 10 left and right.

The can release buttons 40 of the remote transmitter 36 are used to control the spring assemblies 28. When the user actuates the can release buttons 40 of the remote transmitter 36, said remote transmitter 36 sends the radio signal through the antenna to the receiver 38 on board the toy vehicle 10. The receiver 38 is in communication with each of the solenoids 32, and when the user depresses the specific can release button 40 on the remote transmitter 36 a signal is sent to the solenoid 32 selectively chosen by the user. The signal energizes the solenoid 32, which causes the pin 34 to withdraw inwardly, thereby allowing the spring 30 to uncoil., and thrust the can upwardly from the circular receptacle 16 into the air.

Figure 5:
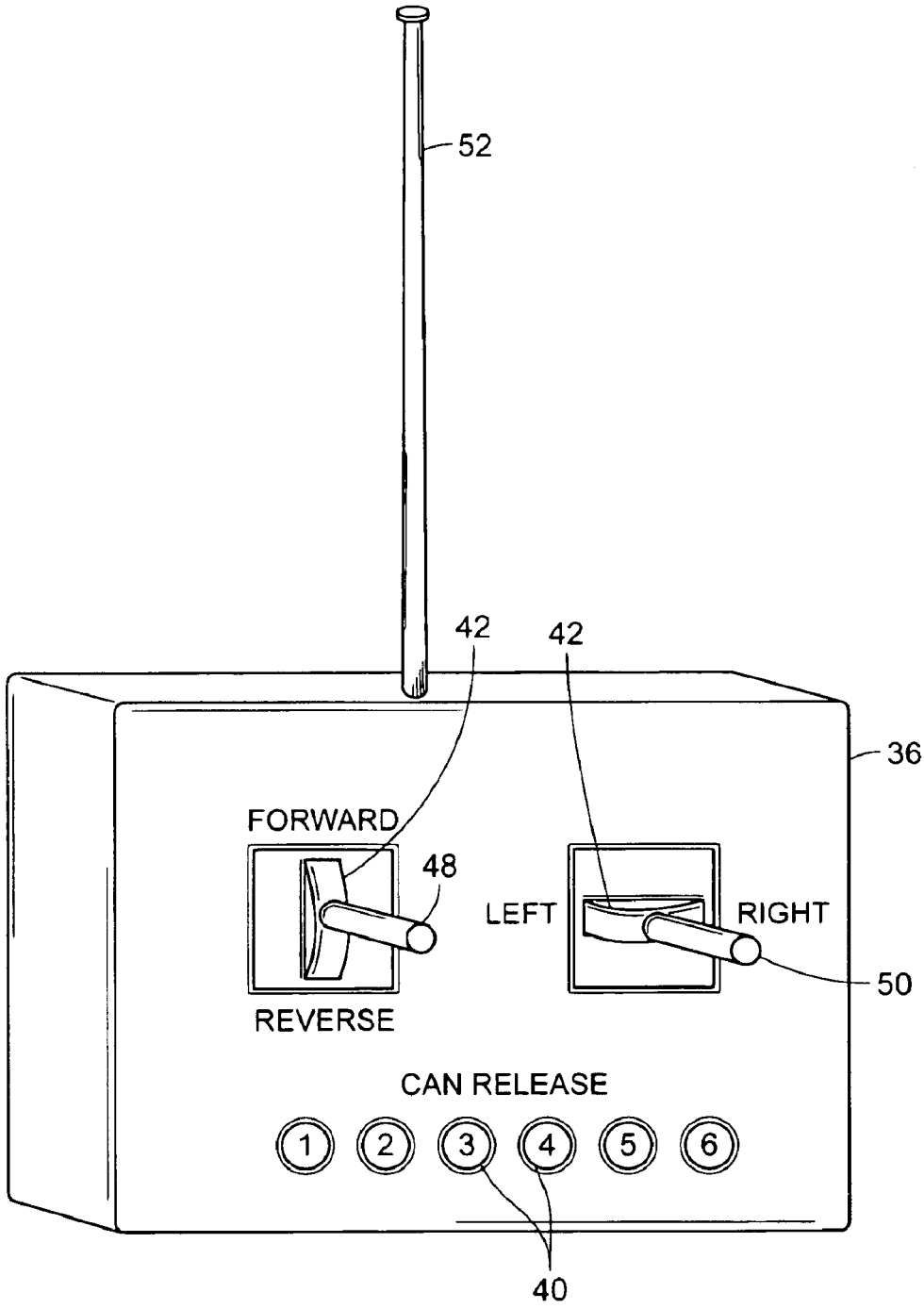
FIG. 5 illustrates a remote transmitter having directional controls and can release buttons for sending signals by an antenna to the receiver of the toy vehicle.

FIG. 5 illustrates the remote transmitter 42 of the present invention. The first joystick 48 has a forward position and a reverse position, and is used to control the drive motor 44. When the first joystick 48 is pushed into the forward position, the drive motor 44 of the toy vehicle 10 accelerates and moves the toy vehicle 10 forward. When the first joystick 48 is pushed into the reverse position, the drive motor of the toy vehicle 10 decelerates and reverses directions. The second joystick 50 has a left position and a right position, and is used to control the steering motor 46 of the toy vehicle 10. When the second joystick 50 is pushed into the left position the steering motor 46 of the toy vehicle 10 turns said toy vehicle 10 left. When the second joystick 50 is pushed into the right position, the steering motor 46 of the toy vehicle 10 turns said toy vehicle 10 right.

The can release buttons 40 of the remote transmitter 36 allow the user to selectively choose which can is released, by pairing each one of the circular receptacles 16 with the numbered can release button 40 on the remote transmitter 36. This allows the user to select which can of soda or beer they want to drink.

In conclusion, herein is presented a remote control toy vehicle. The invention is illustrated by example in the drawing figures, and throughout the written description. It should be understood that numerous variations are possible, while adhering to the inventive concept. Such variations are contemplated as being a part of the present invention.

What is claimed is:

1. A toy vehicle, having a rear cargo unit, for releasing cans of beer and soda from within the rear cargo unit of the vehicle upwardly into the air, under the control of a remote transmitter capable of transmitting radio signals, comprising:

a receiver for receiving radio signals from the transmitter;

a drive motor attached to the toy vehicle and in communication with the receiver for providing mobility to the vehicle;

a steering motor attached to the toy vehicle and in communication with the receiver for alerting direction of the toy vehicle;

a plurality of circular receptacles attached to the rear cargo unit of the toy vehicle, each having a bottom interior surface, adapted to hold cans of, beer and soda therein;

a plurality of spring assemblies, each having a solenoid and a spring, said spring is coupled to the bottom interior surface of each receptacle for allowing the can to rest thereon and discharging the can upwardly into the air from the circular receptacle when the solenoid is energized, each solenoid is in communication with the receiver.

2. The toy vehicle of claim 1, wherein the spring assemblies each have a pin extending through the circular receptacle from the solenoid for holding down the spring.

3. The toy vehicle of claim 2, wherein the solenoid of the spring assembly is energized, causing the pin to withdraw into the solenoid and out of the circular receptacle, thereby allowing the spring to uncoil and thrust the can upwardly into the air.

4. The toy vehicle of claim 3, wherein the rear cargo unit has a bottom surface and a plurality of walls extending upwardly from the bottom surface for housing the cans of beer and soda therein.

5. The toy vehicle of claim 4, wherein the circular receptacles are recessed into the rear cargo unit of the toy vehicle.

6. The toy vehicle of claim 5, further comprising a lid, having a plurality of circular openings, for accepting the cans of beer and soda therethrough, said lid removable secured to the rear cargo unit of the vehicle.

7. The toy vehicle of claim 6, wherein the circular receptacles are sized to accommodate cans of beer and soda therein.

8. A method of receiving a cold beverage from a toy vehicle under the control of a remote transmitter, said remote transmitter includes directional controls, can release buttons, and an antenna for transmitting radio signals therethrough, said toy vehicle having a receiver for communicating with the remote transmitter, said toy vehicle having a plurality of receptacles each having a bottom interior surface for housing cans of beer and soda therein, each having a spring assembly, having a solenoid, a spring attached to the bottom surface of each receptacle, and a pin extending from the solenoid through the receptacle for holding the spring underneath the can of beer or soda, each solenoid in communication with the receiver, said toy vehicle having a drive motor and a steering motor both in communication with the receiver, the steps comprising:

actuating one of the can release buttons on the remote transmitter;

transmitting the radio signal by the antenna of the remote transmitter to the receiver;

receiving the signal by the receiver; and propelling the can into the air by releasing the spring, by retracting the pin, by energizing the solenoid.

9. The method of claim 8, wherein the user can actuate the direction controls on the remote transmitter for controlling the drive motor and the steering motor.

* * * * *